US007784253B2

(12) United States Patent
Blome

(10) Patent No.: US 7,784,253 B2
(45) Date of Patent: Aug. 31, 2010

(54) APPARATUS FOR THE HEAT TREATMENT OF PACKS

(75) Inventor: Hermann Blome, Blender-Einste (DE)

(73) Assignee: Focke & Co. (GmbH & Co. KG) (DE)

( * ) Notice: Subject to any disclaimer, the term of this patent is extended or adjusted under 35 U.S.C. 154(b) by 214 days.

(21) Appl. No.: 12/066,427

(22) PCT Filed: Aug. 16, 2006

(86) PCT No.: PCT/EP2006/008059

§ 371 (c)(1),
(2), (4) Date: Mar. 11, 2008

(87) PCT Pub. No.: WO2007/036262

PCT Pub. Date: Apr. 5, 2007

(65) Prior Publication Data

US 2008/0250757 A1 Oct. 16, 2008

(30) Foreign Application Priority Data

Sep. 27, 2005 (DE) ..... 10 2005 046 304

(51) Int. Cl.
*B65B 53/02* (2006.01)

(52) U.S. Cl. ..... 53/557; 53/440

(58) Field of Classification Search ..... 53/440, 53/442, 557; 198/418.4, 483.1, 626.2, 445, 198/447; 414/795.4, 796, 796.2, 788.8, 790.9, 414/791

See application file for complete search history.

(56) References Cited

U.S. PATENT DOCUMENTS

| | | | | |
|---|---|---|---|---|
| 2,037,631 A | | 4/1936 | Hultin | |
| 3,166,462 A | | 1/1965 | Schoder | |
| 3,640,049 A | * | 2/1972 | Fritz et al. | 53/442 |
| 4,330,977 A | * | 5/1982 | Focke | 53/371.7 |
| 7,131,247 B2 | * | 11/2006 | Boriani et al. | 53/442 |
| 7,200,978 B1 | * | 4/2007 | Focke et al. | 53/441 |
| 2006/0130433 A1 | * | 6/2006 | Wilder et al. | 53/442 |
| 2009/0211203 A1 | * | 8/2009 | Boriani et al. | 53/442 |

FOREIGN PATENT DOCUMENTS

| | | |
|---|---|---|
| CH | 510 556 A | 7/1971 |
| DE | 1 073 934 | 11/1960 |
| DE | 38 24 924 A1 | 1/1990 |
| DE | 199 54 169 A1 | 3/2001 |

(Continued)

OTHER PUBLICATIONS

International Search Report.

(Continued)

*Primary Examiner*—Hemant M Desai
(74) *Attorney, Agent, or Firm*—Smith, Gambrell & Russell

(57) ABSTRACT

For the heat treatment of cigarette packs (10) having an outer wrapper made of shrink film, the packs (10) can be conveyed in pairs, one above the other, through a shrink-fitting subassembly (20). During a standstill phase, heating plates (22, 23, 24) butt against upwardly and downwardly oriented pack surfaces in order to transmit heat. The heating plates (22, 24) can be moved upward and downward in order that the pack (10) is free of loading during the conveying cycle.

12 Claims, 7 Drawing Sheets

FOREIGN PATENT DOCUMENTS

Figure 1:
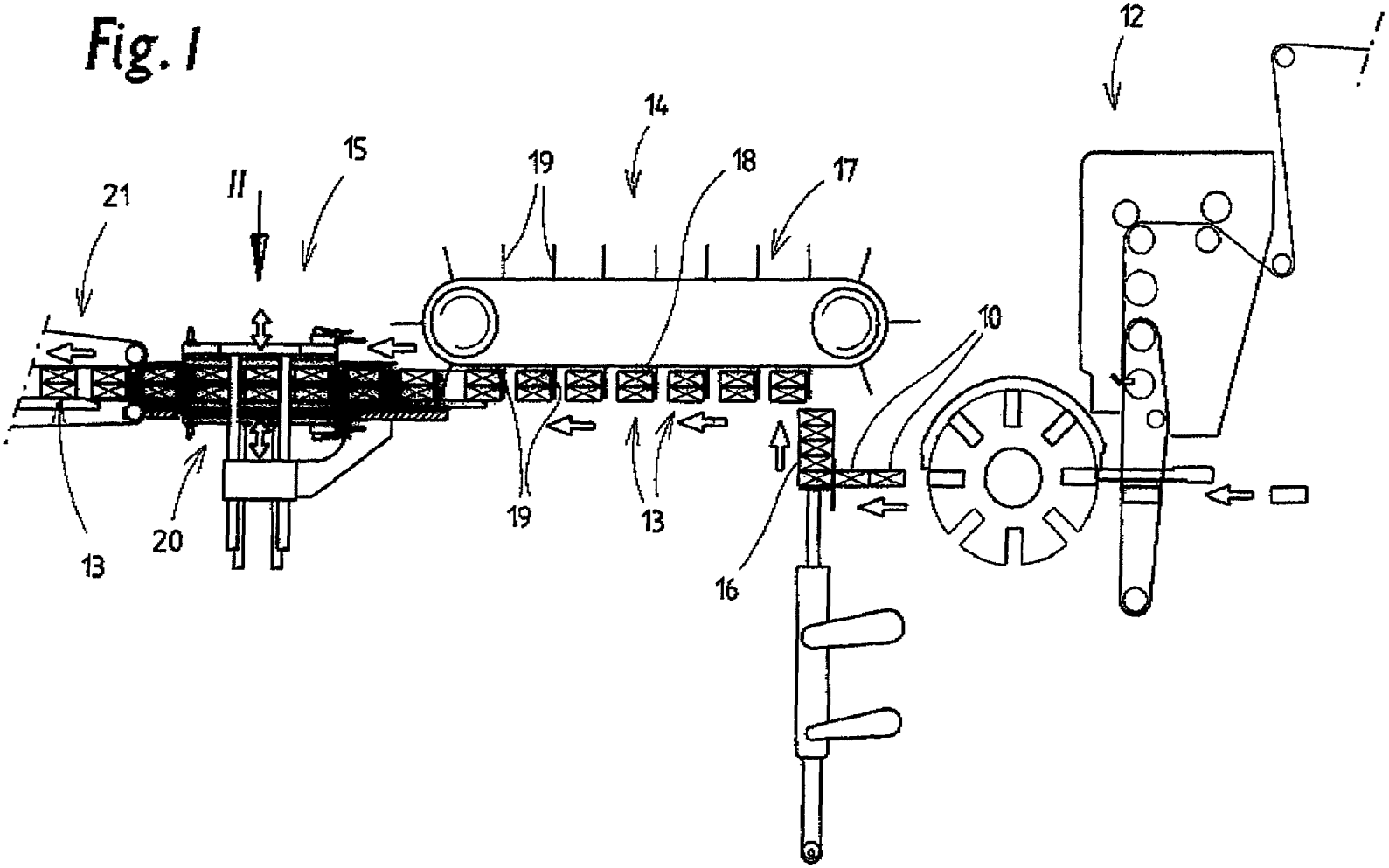

| | | | |
|---|---|---|---|
| DE | 199 57 415 | A1 | 5/2001 |
| EP | 1 055 603 | A | 11/2000 |
| EP | 1 103 465 | A1 | 5/2001 |
| EP | 1 574 437 | A | 9/2005 |
| EP | 1574435 | | 9/2005 |
| EP | 1 652 772 | A | 5/2006 |

OTHER PUBLICATIONS

German Search Report.

* cited by examiner

Fig.6
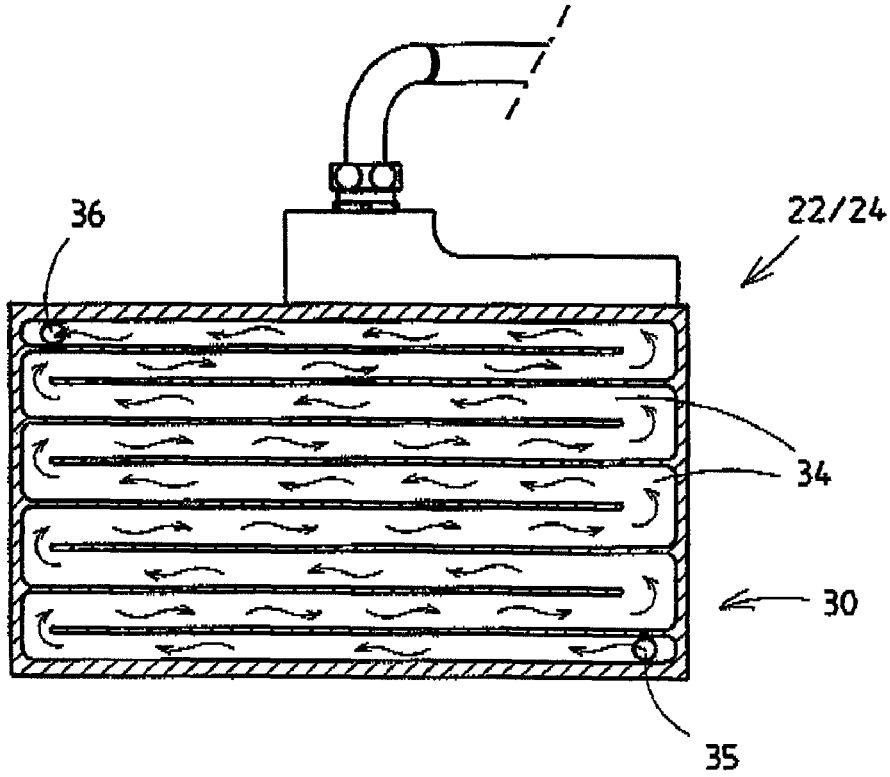
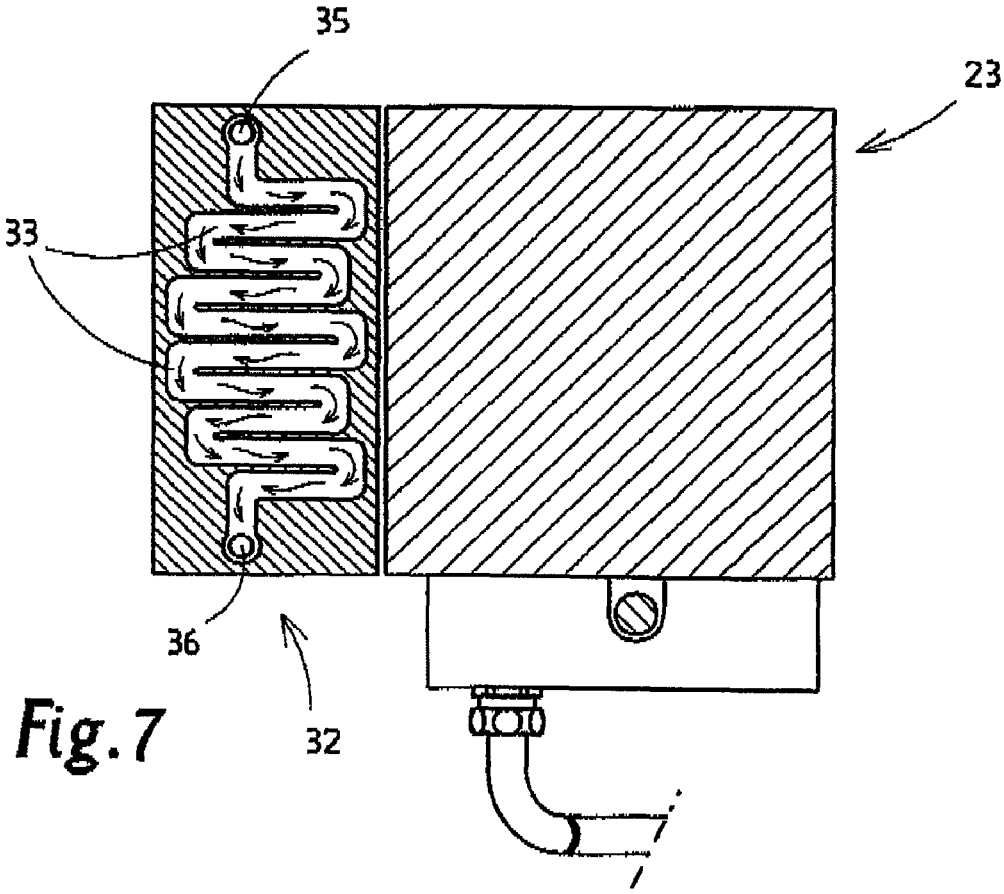
Fig.7

APPARATUS FOR THE HEAT TREATMENT OF PACKS

STATEMENT OF RELATED APPLICATIONS

This application is the U.S. National Phase Under Chapter II of the Patent Cooperation Treaty (PCT) of PCT International Application No. PCT/EP2006/008059 having an International Filing Date of 16 Aug. 2006, which claims priority on German Patent Application No. 10 2005 046 304.5 having a filing date of 27 Sep. 2005.

BACKGROUND OF THE INVENTION

1. Technical Field

The invention relates to a process for the heat treatment of cuboidal packs, in particular (cigarette) packs having an outer wrapper made of shrink film, which are conveyed as a pack group, made up of preferably two packs located one above the other, through a heating or shrink-fitting subassembly with heating means butting temporarily against the packs. The invention also relates to an apparatus for carrying out the process.

2. Related Art

The above process and a corresponding apparatus are known from EP 1 084 954 A2.

In the prior art, a shrink-fitting subassembly is provided downstream of a sealing station for the thermal sealing of folding tabs of the outer wrapper. The shrink-fitting subassembly has plate-like heating means which butt against a respective pack side in order to transmit heat. The packs are conveyed in a closely packed row through the shrink-fitting subassembly, that is to say by pressure being transmitted for cyclic movement from pack to pack.

BRIEF SUMMARY OF THE INVENTION

The object of the invention is to improve the quality of the shrink-fitting process, to be precise by way of the packs being positioned precisely in the region of the shrink-fitting subassembly and by way of a balanced, precise transmission of heat.

In order to achieve this object, the apparatus according to the invention is characterized in that the packs, or pack groups each made up two packs arranged one above the other, can be transported by pack conveyors arranged alongside a movement path of the packs, with spacings being formed between the successive packs or pack groups at least in the region of the shrink-fitting subassembly.

In the case of the apparatus according to the invention, the packs are thus transported without coming into contact with one another, the pack conveyor being arranged outside the region of the heating means of the shrink-fitting subassembly such that it is merely drivers for gripping the packs on a rear side, namely on a narrow, elongate side surface of the cuboidal cigarette packs, that enter into the movement region of the packs. The latter can be transported very precisely (cyclically) by loose conveying belts preferably arranged on either side of the movement path of the packs, in which case the packs assume a precise position in the region of the shrink-fitting station. The conveying belts are arranged such that they receive the packs downstream of a sealing station, to be precise upstream of the shrink-fitting station and/or upstream of the heating means of the same, and convey them through the entire shrink-fitting subassembly.

The configuration and operation of the shrink-fitting station or of the shrink-fitting subassembly constitute a further special feature. This subassembly, according to the invention, has top and bottom plate-like heating means and at least one central plate-like heating means, the latter emitting heat to packs in the upward and downward directions. The top heating means, on the one hand, and the bottom heating means, on the other hand, can be moved upward and downward for the transportation of the packs, in particular for individual conveying cycles, in particular such that the top heating means can be raised up from the top packs, while bottom packs are freed from the central heating means as a result of the lowering movement.

Further special measures relate to the capacity to regulate the heat supply by a corresponding design of the heating means, to the cooling of the packs following the shrink-fitting operation, namely prior to the packs of a pack group, which have been separated from one another during the shrink-fitting process, being brought together, and to the design and operation of conveying means for transporting the packs in the region of the shrink-fitting station.

BRIEF DESCRIPTION OF THE DRAWING FIGURES

Figure 2:
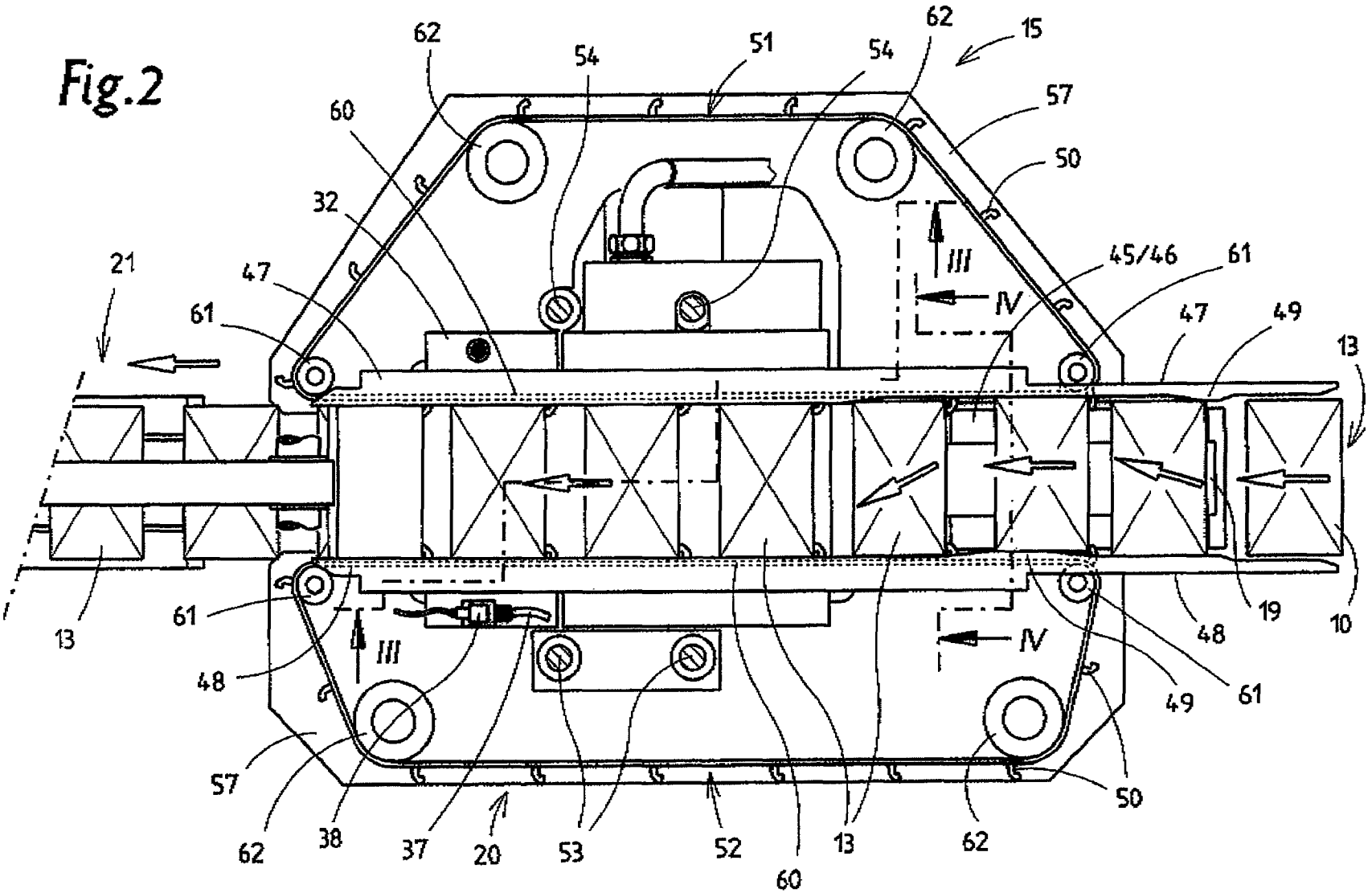
Figure 3:
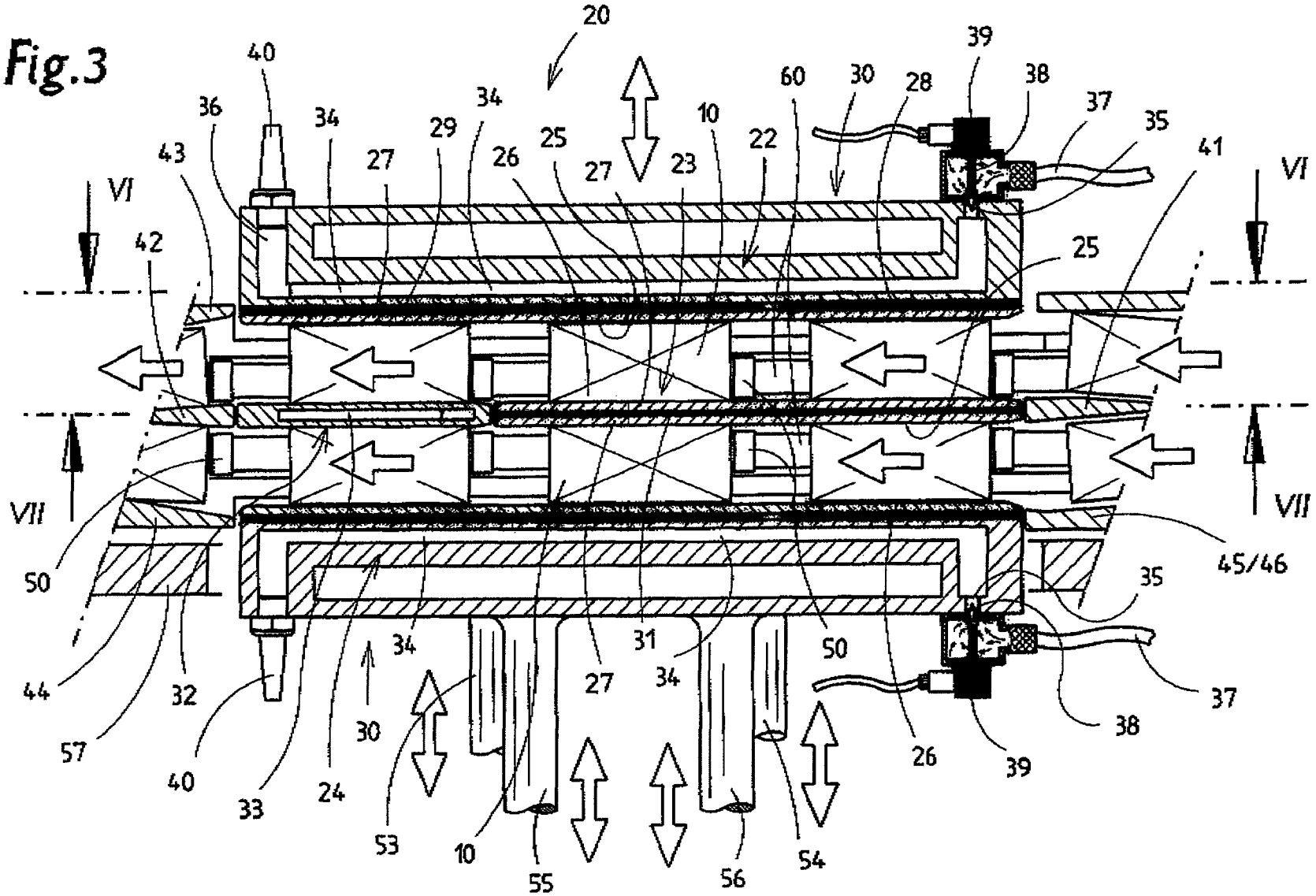
Figure 4:
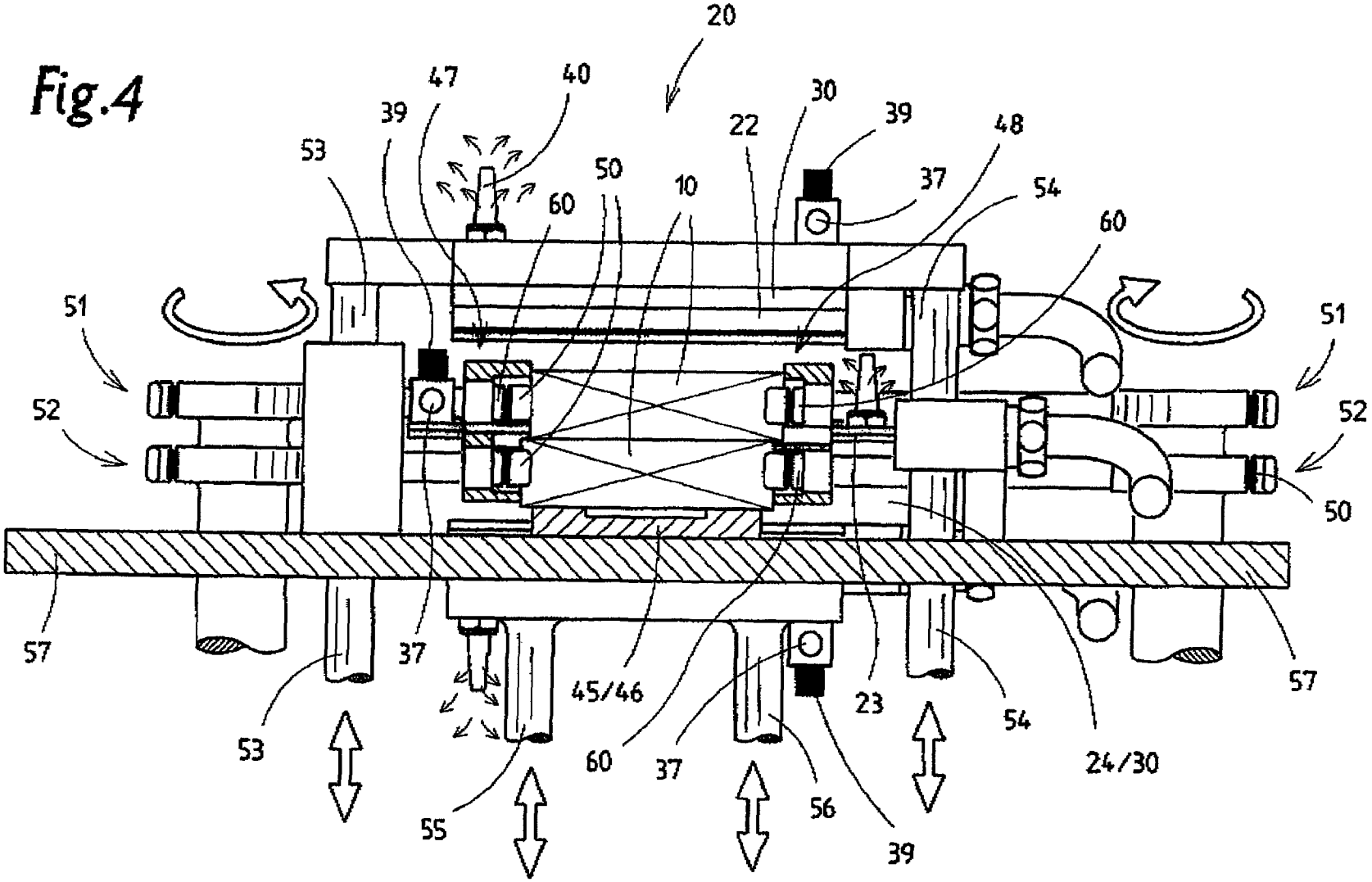
Figure 5:
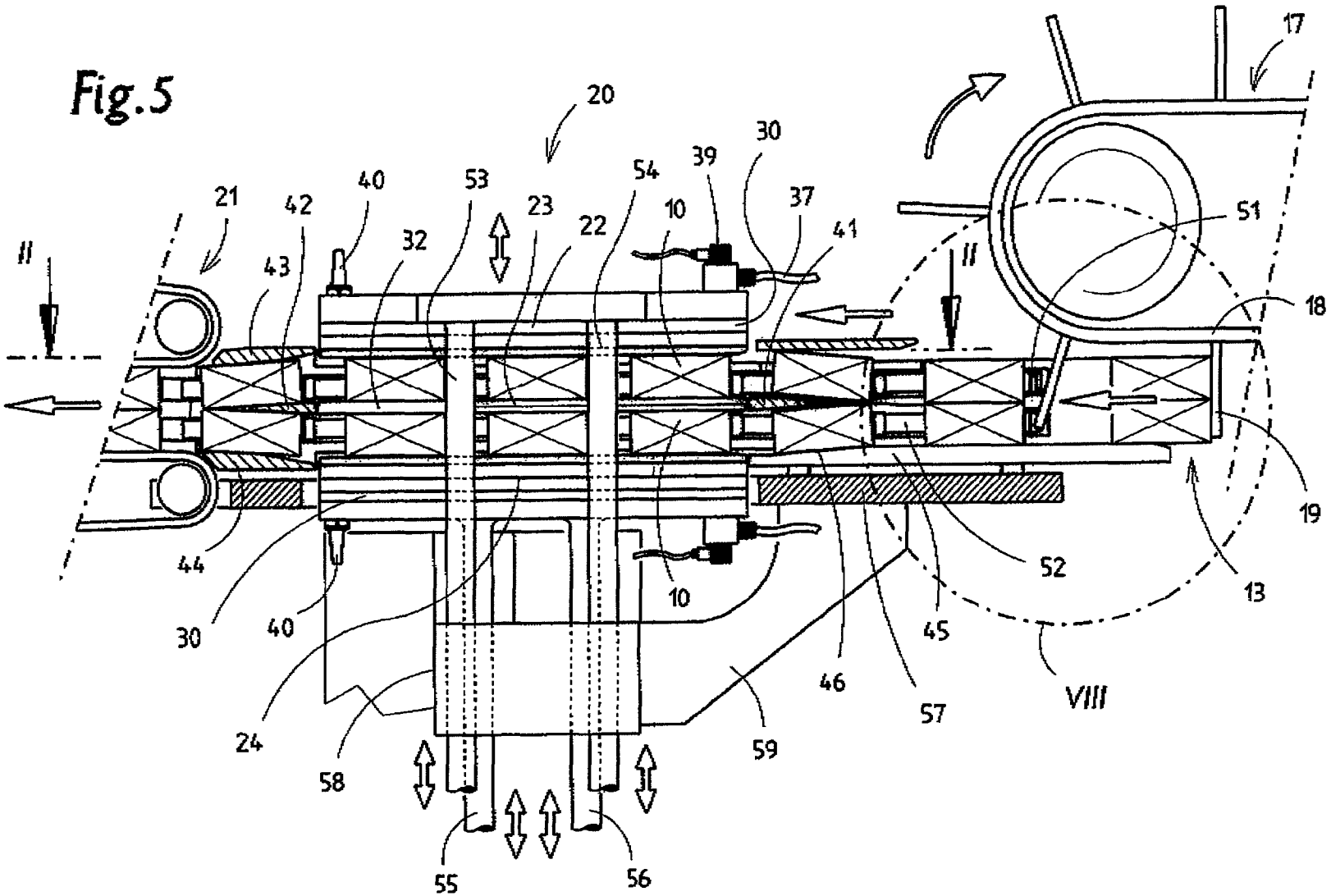

Further details of the invention will be explained in more detail hereinbelow with reference to the drawings, in which:

FIG. 1 shows a schematic side view of part of a packaging machine with a shrink-fitting station, FIG. 2 shows, on an enlarged scale, the shrink-fitting station or a shrink-fitting subassembly in plan view, FIG. 3 shows the shrink-fitting subassembly in longitudinal section along section plane III-III from FIG. 2, FIG. 4 shows a cross section of the shrink-fitting subassembly along section IV-IV from FIG. 2, FIG. 5 shows the shrink-fitting subassembly in side view, partly in longitudinal section, FIG. 6 shows a detail of the shrink-fitting subassembly in horizontal section along section plane VI-VI in FIG. 3, FIG. 7 shows a further detail of the shrink-fitting subassembly along an offset horizontal section plane VII-VII from FIG. 3, and FIGS. 8 to 11 show a side view and a plan view of a detail of the shrink-fitting station during transfer of the packs, during different movement phases.

DETAILED DESCRIPTION OF PREFERRED EMBODIMENTS

For the production of packs 10 having an outer wrapper 11 made of heat-shrink film, a film blank is folded around the pack 10 in the region of a folding station 12. The wrapped packs 10 are arranged so as to form pack groups 13 each made up of two packs 10 located one above the other, and these are conveyed through a sealing station 14. In the region of the latter, folding tabs of the outer wrapper 11 are connected to one another by heat sealing. The resulting packs 10 then pass into a shrink-fitting station 15. This transmits heat to the packs 10 or to the outer wrappers 11, which, on account of the nature of the material, shrink and thus enclose the pack 10 in a crease-free manner. These packs 10 are hard packs, in particular hinge-lid boxes for cigarettes.

In the sealing station 14, the packs 10, in the first instance, are conveyed upward in the form of a pack tower 16. Sideways directed folding tabs in the region of narrow side surfaces of the packs 10 are connected to one another here by sealing. An endless conveyor in the sealing station 14, namely a group conveyor 17, transports pack groups 13 in each case by way of a bottom strand 18, each pack group 13 being assigned a crosspiece 19 as a driver. These drivers are spaced apart in order to create spacings between successive pack groups 13. In the region of the group conveyor 17, folding tabs on sideways directed end and base sides of the packs 10 are connected to one another by sealing.

The pack groups 13 are transferred to a shrink-fitting subassembly 20 of the shrink-fitting station 15, and conveyed through the same, with this formation being maintained. During this operation, heat is transferred to the packs 10, to be precise to the upwardly directed and downwardly directed large-surface-area pack sides (front side/rear side). Following the shrink-fitting process, the packs 10 are transferred to a removal conveyor 21, during which time the pack groups 13 are maintained.

The shrink-fitting subassembly 20 has heating means for transmitting heat to the packs 10. These heating means are in the form of heating plates 22, 23, 24. The packs 10 butt against these heating plates by way of a large-surface-area top side 25 and of a corresponding underside 26 for heat-transmission purposes. The heating means or heating plates 22, 23, 24 extend over the entire width or transverse dimension of the packs 10. The heating plates 22, 23, 24 are dimensioned, as seen in the movement direction, such that heat is transmitted by heating means and packs 10 butting against one another over the course of a number of shrink-fitting positions or standstill phases of the packs 10, namely during three operating cycles.

The top and bottom heating plates 22, 24 are of largely corresponding design. An in particular continuous cover panel 27 is arranged on a side which is directed toward the packs 10. This panel is in contact with the packs 10. The cover panel 27 thus preferably consists of polished (metallic) material with a high level of thermal conductivity. Heating means, namely planar heating elements 28, 29, are arranged on the outside of the cover panel 27. These heating elements are electric resistance heaters, for example configured as in EP 1 084 954 A2. The free outer side of the multi-layered heating plates 22, 24 comprises a cavity-containing carrying panel 30. The central heating plate 23 is of analogous construction, namely with a central heating element 31 and cover panels 27 on the top side and underside. Accordingly, the central heating element 23 is set up for transmitting heat in the upward and downward directions.

The temperatures in the heating means can be suitably regulated. A further special feature is constituted by the fact that the top and bottom heating plates 22, 24 have a changeable temperature profile in the conveying direction. In the exemplary embodiment shown it provides two (planar) heating elements 28, 29 with different temperatures, in particular temperatures which drop in the movement direction. The heating elements 28, 29, which are separated from one another by an interspace, have different thermal outputs. The dimensions are selected such that the packs 10 entering into the shrink-fitting subassembly 20 are subjected to elevated temperature in the region of the heating element 28 in a first operating cycle and to low temperature in each case by the heating element 29 in the following operating cycles.

As a special feature, the central heating plate 23 is designed such that it extends only (continuously) in the region of the first (two) shrink-fitting positions. In the region of the final or third shrink-fitting position of the packs 10 (of a pack group 13), a cooling means, namely a cooling plate 32, is arranged between these packs. Accordingly, the packs 10 subjected to the action of heat are cooled, prior to leaving the shrink-fitting station 15, in the region of the pack sides 25, 26 directed toward one another, and this avoids thermal bonding when the packs 10 are brought together again in the region of the removal conveyor 21. Cooling takes place by way of a suitable cooling medium, in particular air. This is introduced into a cavity in the cooling plate 32 and guided through the same. The cavity of the cooling plate 32 is designed in the form of a winding flow channel 33 (FIG. 7).

It is also the case that the top and bottom heating plates 22, 24 can be cooled, in particular in the event of operation being briefly interrupted. The carrying panels 30 are provided with a cavity which is directed toward the heating elements 28, 29 and through which a cooling medium (air) can be directed. This cavity is in the form of winding flow channels 34 (FIG. 6) with an inlet opening 35 and an outlet opening 36. An (air) duct 37 leads to the inlet opening 35. The latter can be closed off by a closure means, namely by a valve cone 38. This valve cone can be actuated by an electrical switching means 39. The air is supplied under pressure for cooling purposes. The drop in pressure in the region of the flow channel 34 gives rise to an additional cooling effect. A sound damper 40 is arranged at the outlet opening 36.

The operations of guiding and conveying the packs 10 through the shrink-fitting subassembly 20 constitute a special feature. The packs 10, arriving in particular in the form of a pack group 13, are separated from one another by movement in the upward and downward directions, that is to say by a uniform spreading-apart movement. For this purpose, the packs 10 are directed, via a wedge-shaped, central guide component 41, onto the top side of the central heating plate 23 and onto the bottom heating plate 24. The guide component 41 is directly adjacent to the central heating plate 23. An analogous guide component 42 is arranged on the opposite side. This guide component causes the top side 25 and underside 26 of the packs 10 to be brought into abutment against one another as the packs 10 are transported further. A mouthpiece with a top guide 43 and bottom guide 44 directs the packs 10 from the spaced-apart position into abutment against one another. The mouthpiece with the top guide 43 and bottom guide 44 is positioned as a (single-piece) bridge between the shrink-fitting subassembly 20 and conveyor 21 (FIG. 5).

In the inlet region of the shrink-fitting subassembly 20, the packs 10 or pack groups 13 run on a bottom guide plate 45. This has, on the entrance side, a downwardly inclined guide surface 46 for the respectively bottom pack 10.

It is also the case that provision is made, in the entrance region to the shrink-fitting subassembly 20, for the packs 10 of the pack group 13 to be displaced transversely relative to one another, in order to ensure straightforward separation of the packs 10. Guide rails 47, 48 are arranged, as a lateral guide, on either side of the packs 10. In the entrance region, these rails form transversely directed protrusions 49 and corresponding set-back sections. This ensures that, during transportation, at least the top packs 10 of the pack group 13 are transversely displaced and then return into the congruent starting position, as is shown by a number of arrows in FIG. 2.

The transportation of the packs 10 or of the pack groups 13 in the region of the shrink-fitting station 15 constitutes a special feature. The pack groups 13 are transported cyclically by pack conveyors from shrink-fitting position to shrink-fitting position, with spacings between successive pack groups 13 being maintained in the process. Each pack group is gripped, and carried along, on the rear side by drivers 50 of lateral conveying belts 51, 52. As can be seen in particular from FIG. 4, two conveying belts 51, 52 located one above the other are provided on each side and are assigned to the top and bottom packs 10 of the pack groups 13. The conveying belts 51, 52 are guided in pairs over (four) deflecting rollers 61, 62 on either side of the movement path of the packs 10. The lateral guides, namely the guide rails 47, 48 have slot-like apertures and depressions for the through-passage of the conveying belts 51, 52 and of the drivers 50, respectively.

The conveying belts 51, 52, which are arranged in a trapezoidal formation as a result of the deflecting rollers 61, 62, form, by way of the deflecting rollers 61 assigned to the packs 10, a conveying strand 60 which runs, over the entire conveying route, in the immediate vicinity of the end and base surfaces of the packs 10. The conveying strands 60 run within the U-shaped or angular guide rails 47, 48.

Figure 8:
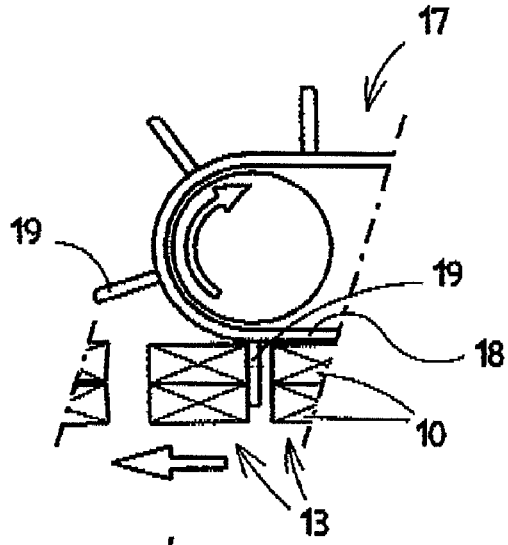
Figure 9:
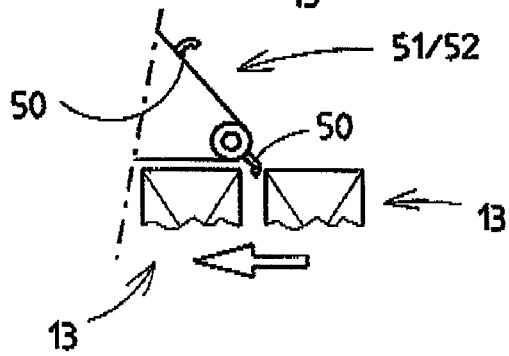
Figure 10:
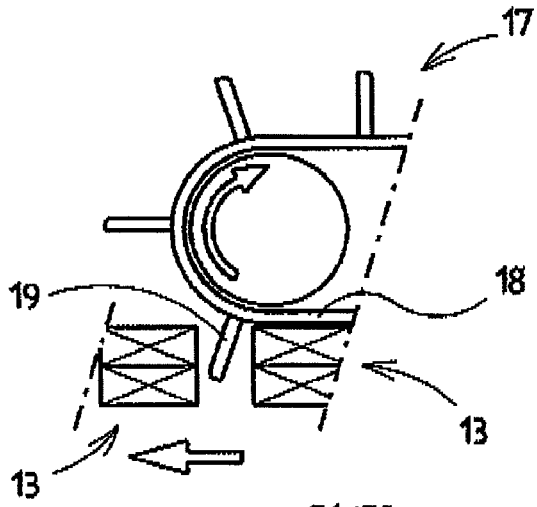
Figure 11:
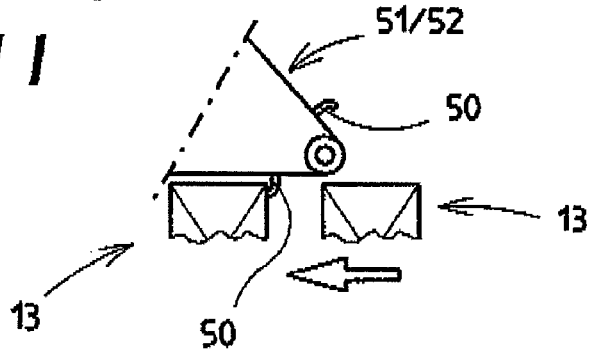

The lateral conveying belts 51, 52 receive the pack groups 13 from the feed conveyor, namely from the group conveyor 17, in a particular manner. The conveying belts 51, 52 extend into the facing end region of the group conveyor 17, in which case a pack group 13 is gripped by drivers 50 of the conveying belts 51, 52 while a downwardly directed driver 19 is still located in the conveying position (FIGS. 8 and 9). The drive of the conveying belts 51, 52 is regulated such that the pack group 13 gripped is transported further at elevated speed and thus detaches itself from the driver 19 of the group conveyor 17 (FIGS. 10 and 11). The driver 19 can then pass out of the movement path of the packs 10, without any disruption, by virtue of the group conveyor 17 being deflected. The conveying belts 51, 52 can be driven overall at a higher speed than the group conveyor 17, or at a non-uniform speed. The conveying belts 51, 52 are dimensioned, and guided by the deflecting rollers 61, 62, such that the packs 10 are received, and transported, at a distance upstream of the shrink-fitting subassembly 20 and/or upstream of the heating plates 22, 23, 24.

It is particularly important, for the operation of the shrink-fitting subassembly 20, for the heating means or heating plates 22, 24 to be able to move, in order that the packs 10 are not subjected to loading, during a conveying cycle, by heating means butting against them on both sides. For this purpose, the heating plates 22, 24 can be moved up and down in a controlled manner in coordination with the operating cycles.

The top heating plate 22 can be raised as a unit from the respectively top packs 10. Furthermore, the bottom heating plate 24 can be lowered (at the same time). For a conveying cycle to be carried out, it is thus the case that the top packs 10 rest (only) on the central heating plate 23 and/or on the cooling plate 32. The bottom packs 10 are lowered with the bottom heating plate 24 and rest on the latter—at a distance from the central heating plate 23 —as the movement surface.

The two heating plates 22 and 24 are actuated from beneath via lifting means. The top heating plate 22 can be moved up and down by in each case two lifting rods 53, 54 arranged at the ends. In the same way, lifting rods 55, 56 can be moved up and down for the bottom heating plate 24. The coordinated actuation of the lifting rods 53, 54 and 55, 56 takes place by way of suitable actuating means (not shown), in particular cam plates, which are arranged beneath a continuous retaining panel 57, which accommodates the entire shrink-fitting subassembly 20. The lifting rods 53, 54, 55, 56 are connected in each case to the carrying panels 30 of the top and bottom heating plates 22, 24.

The central retaining panel 57 bears all the mechanisms of the shrink-fitting subassembly 20, including the conveying means. There is also a connection between the lifting rods 53, 54, 55, 56, with guides 58 to the retaining panel 57 via a sideways directed carrying arm 59. This retaining panel is connected in a suitable manner to a machine framework (not shown).

LIST OF REFERENCE NUMBERS

10 Packs
11 Outer wrapper
12 Folding station
13 Pack group
14 Sealing station
15 shrink-fitting station
16 Pack tower
17 Group conveyor
18 Bottom strand
19 Crosspiece
20 Shrink-fitting subassembly
21 Removal conveyor
22 Heating plate
23 Heating plate
24 Heating plate
25 Top side
26 Underside
27 Cover panel
28 Heating elements
29 Heating elements
30 Carrying panel
31 Heating elements
32 Cooling plate
33 Flow channel
34 Flow channel
35 Inlet opening
36 Outlet opening
37 Duct
38 Valve cone
39 Switching means
40 Sound damper
41 Guide component
42 Guide component
43 Top guide
44 Bottom guide
45 Guide plate
46 Guide surface
47 Guide rails
48 Guide rails
49 Protrusion
50 Driver
51 Conveying belt
52 Conveying belt
53 Lifting rod
54 Lifting rod
55 Lifting rod
56 Lifting rod
57 Retaining panel
58 Guide
59 Carrying arm
60 Conveying stand
61 Deflecting rollers
62 Deflecting rollers

What is claimed is:

1. An apparatus for the heat treatment of cuboidal packs (10) having an outer wrapper (11) made of shrink film, the apparatus having a shrink-fitting subassembly through which the packs (10) are conveyed in a conveyance direction cyclically one after the other, the shrink-fitting subassembly (20) having heating means, namely heating plates (22, 23, 24), butting against the packs (10) during a standstill phase, wherein:

a) the packs (10), individually or as a pack group (13) each made up of two packs (10) arranged one above the other, are transported by a cyclically driven pack conveyor through the shrink-fitting subassembly (20);

b) during the standstill phase of the packs (10), the heating plates (22, 23, 24) butt against a large-surface top side (25) and/or a large surface underside (26) of the packs (10);

c) the pack conveyor comprises endless conveying belts (51, 52) arranged on either side of a movement path of the packs (10) and with conveying strands (60) face laterally directed pack surfaces;

d) the conveying belts (51, 52) comprise drivers (50) for gripping the pack (10) or the pack group (13) on its rear side; and e) the packs (10) or the pack group (13) are transported at a distance from another of the packs (10) or the pack group (13), respectively, due to the corresponding arrangement of the drivers (50) on the conveying belts (51, 52).

2. The apparatus as claimed in claim 1, wherein:

the packs (10) are transported with their longitudinal extension directed transversely with the large-surface top side (25) directed upwards, the large surface underside (26) directed downwards, and with transversely-directed narrow side surfaces lying at the front side and rear side of the packs (10);

the conveying belts (51, 52) are guided over deflecting rollers (61, 62) in a horizontal plane approximately at half the height of the packs (10); and the conveying strands (60), which run at either side of the movement path of the packs (10) and which are directed toward one another, grip the packs (10) on the rear side, namely on the narrow side surfaces at the rear of the packs (10), by way of the drivers (50).

3. The apparatus as claimed in claim 2, wherein for the transport of pack groups (13) comprising two of the packs (10) arranged one above the other, in each case two of the conveying belts (51, 52) run at either side of the movement path of the packs (10), with their respective drivers (50) being assigned to one of the packs (10) of the pack group (13).

4. The apparatus as claimed in claim 2, wherein the conveying strands (60) of the conveying belts (51, 52) extend beyond the region of the heating plates (22, 23, 24) by way of an initial or receiving portion into the conveying region of a group conveyor (17) for the packs (10) supplied.

5. The apparatus as claimed in claim 1, wherein the packs (10) are subjected to heat by the heating plates (22, 23, 24) butting against the packs (10) in three successive operating cycles or standstill phases.

6. The apparatus as claimed in claim 1, wherein:

the packs (10), or pack groups (13) comprising two packs (10) arranged one above the other, can be supplied to the shrink-fitting subassembly (20) by an endless group conveyor (17);

the group conveyor (17) has drivers (19) for packs (10) or pack groups (13) arranged approximately at the height of the packs (10) or pack groups (13);

the conveying belts (51, 52) of the shrink-fitting subassembly (20) extend into the region of the group conveyor (17) such that a respective front pack (10) or front pack group (13) can be gripped, and transported away, by the drivers (50) of the conveying belts (51, 52); and the conveying speed of the conveying belts (50, 51) is greater than the conveying speed of the group conveyor (17).

7. An apparatus for the heat treatment of cuboidal packs (10) having an outer wrapper (11) made of shrink film, comprising:

a) a shrink-fitting subassembly (20) through which the packs (10) are conveyed in a conveyance direction cyclically one after the other;

b) three heating plates (22, 23, 24) located within the shrink-fitting subassembly, the heating plates (22, 23, 24) butting against the packs (10) during a standstill phase, and the heating plates (22, 23,24) being a top heating plate (22), a central heating plate (23), and a bottom heating plate (24), the three heating plates (22, 23, 24) being arranged at a distance from one another and one above the other, wherein:

the packs (10) are conveyed as pack groups (13), each made up of two packs (10) arranged one above the other, cyclically through the shrink-fitting subassembly (20) with a standstill phase, the packs (10) each have a top side (25) and an underside (26), the top side (25) being upwardly oriented during conveyance and the underside (26) being downwardly oriented during transport, during the standstill phase, the top heating plate (22) butts against the top sides (25) of the packs (10) on the top of the pack group (13), the bottom heating plate (24) butts against the underside (26) of the respective packs (10) on the bottom of the pack group (13), the central heating plate (23) butts against the underside (26) of the pack (10) on the top of the pack group (13), on one hand, and against the top side (25) of the pack (10) on the bottom of the pack group (13), and at the end of the standstill phase, the top heating plate (22) is moved upward, and the bottom heating plate (24) is moved downward, such that the packs (10) on the top of the pack group (13) rest on the central heating plate (23) and the top heating plate (22) is lifted off the packs (10) on the top of the pack group (13) while the packs (10) on the bottom of the pack group (13) are moved downwards with the bottom heating plate (24) to form a clearance with respect to the central heating plate (23).

8. The apparatus as claimed in claim 7, wherein the packs (10) of the pack groups (13), on an inlet side of the shrink-fitting subassembly (20), are movable upward and downward in the same manner by a wedge-shaped guide component (41) until the packs (10) butt against the central heating plate (23) and against the bottom heating plate (24), and, on an outlet side of the shrink-fitting subassembly (20), the separated packs (10) are brought together, via an analogously configured wedge-shaped guide component (42) in conjunction with a top guide (43) and bottom guide (44) until the top side (25) and the underside (26) butt against one another.

9. An apparatus for the heat treatment of cuboidal packs (10) having an outer wrapper (11) made of shrink film, comprising:

a) a shrink-fitting subassembly (20) through which the packs (10) are conveyed in a conveyance direction cyclically one after the other; and b) a top heating plate (22), a central heating plate (23) and a bottom heating plate (24) located within the shrink-fitting subassembly (20), the heating plates (22, 23, 24) butting against the packs (10) during a standstill phase, wherein:

the heating plates (22, 23, 24) can be regulated in respect of effective heat by way of a temperature profile in the conveying direction of the packs, and at least the top heating plate (22) and the bottom heating plate (24) have two discrete, separate heating elements (28, 29) with different temperatures.

10. The apparatus as claimed in claim 9, wherein the top heating plate (22) and/or the bottom heating plate (24), can be cooled, and further comprising a carrying panel (30) which accommodates the top heating plate (22) and the bottom heating plate (24) and that has, in a region directed toward the respective heating plate (22, 24), a cavity for introducing a cooling medium.

11. An apparatus for the heat treatment of cuboidal packs (10) having an outer wrapper (11) made of shrink film, comprising:

a) a shrink-fitting subassembly (20) through which the packs are conveyed in a conveyance direction cyclically one after the other, and b) a top heating plate (22), a central heating plate (23) and a bottom heating plate (24) located within the shrink-fitting subassembly (20), the heating plates (22, 23, 24) butting against the packs (10) during a standstill phase, wherein:

in an end region of the shrink-fitting subassembly (20) located immediately following the heating plates (22, 23, 24) in the conveyance direction, the packs (10) can be cooled by a cooling means (32), and the cooling means (32) is arranged in continuation of the central heating plate (23) in the shrink-fitting subassembly (20) between the packs (10) arranged one above the other in a pack group (13).

12. The apparatus as claimed in claim 11, wherein:

the cooling means is a cooling plate (32), and the cooling plate (32) contains winding flow channels (33, 34) through which air, as coolant, can be directed.

* * * * *